US005946802A

United States Patent [19]

Calle et al.

[11] Patent Number: 5,946,802

[45] Date of Patent: Sep. 7, 1999

[54] PROCESS FOR THE MANUFACTURE OF A HOLLOW TURBOMACHINE BLADE AND APPARATUS FOR USE IN SAID PROCESS

[75] Inventors: Gilles Michel George Louis Calle, Chelles; Gilles Charles Klein, Mery/Oise, both of France

[73] Assignee: Societe Nationale d'Etude et de Construction de Moteurs d'Aviation "Snecma", Paris, France

[21] Appl. No.: 08/909,874

[22] Filed: Aug. 12, 1997

[30] Foreign Application Priority Data

Aug. 14, 1996 [FR] France ..... 96 10194

[51] Int. Cl.[6] ..... B23P 15/00

[52] U.S. Cl. ..... 29/889.721; 29/889.72

[58] Field of Search ..... 29/889.72, 889.7, 29/889.721, 889.61, 897.2; 228/157

[56] References Cited

U.S. PATENT DOCUMENTS

| | | | |
|---|---|---|---|
| 4,882,823 | 11/1989 | Weisert et al. | 29/889.72 |
| 5,363,555 | 11/1994 | Fowler et al. | 29/887.7 R |
| 5,457,884 | 10/1995 | Fowler et al. | 29/889.72 |
| 5,636,440 | 6/1997 | Bichon et al. | 29/889.72 |
| 5,692,881 | 12/1997 | Leibfried | 29/889.72 |

FOREIGN PATENT DOCUMENTS

| | | |
|---|---|---|
| 0 500 458 A1 | 8/1992 | European Pat. Off. . |
| 0 700 738 A1 | 3/1996 | European Pat. Off. . |
| 2 739 045 | 3/1997 | France . |

*Primary Examiner*—Irene Cuda
*Attorney, Agent, or Firm*—Oblon, Spivak McClelland, Maier & Neustadt, P.C.

[57] ABSTRACT

In a process for the manufacture of a hollow turbomachine blade in which die-forged and machined sheets are assembled and diffusion welded face to face after applying an antidiffusion coating to areas of the sheets where the assembly is to be expanded in forming the hollow blade, the welded assembly is subjected to a step of unsticking the coated areas of the sheets which are pressed together during the diffusion welding step, the unsticking step including subjecting the assembly to localized heating in a region where the intermediate sheet is provided with intercavity communication holes, and injecting pressurized gas into the welded assembly in a controlled manner to hot form a gas distribution duct in the locally heated region of the assembly to facilitate unsticking of the remainder of the coated areas. Apparatus for use in carrying out the unsticking step is also described.

4 Claims, 2 Drawing Sheets

PROCESS FOR THE MANUFACTURE OF A HOLLOW TURBOMACHINE BLADE AND APPARATUS FOR USE IN SAID PROCESS

BACKGROUND OF THE INVENTION

1. Field of the Invention

The present invention relates to a process for the manufacture of a hollow turbomachine blade in which a plurality of sheets are assembled face to face and diffusion welded together in predetermined areas before being expanded under gas pressure and shaped by superplastic forming. The invention also relates to apparatus for use during a stage of the said process.

The advantages of using large chord blades in turbomachines are particularly evident in the case of fan rotor blades in bypass turbojet engines. However, these blades must cope with severe conditions of use and, in particular, must possess satisfactory mechanical characteristics associated with anti-vibration properties and resistance to impacts by foreign bodies. The need to achieve sufficient speeds at the tips of the blades has furthermore led to research into reducing mass, and this has been achieved, in particular, by the use of hollow blades.

2. Summary of the Prior Art

EP-A-0700738 describes a process for the manufacture of a hollow turbomachine blade, especially a large chord fan rotor blade, the process generally comprising the following steps:

(a) starting from a definition of the blade to be produced, using computer aided design and manufacturing (CAD/CAM) means to create a digital simulation of the flat form of the primary sheet-like parts of the blade;

(b) die-forging the primary parts of the blade in a press;

(c) machining the primary parts;

(d) depositing diffusion barriers on the primary parts according to a predefined pattern which determines the final internal geometry of the blade;

(e) assembling the primary parts and diffusion welding them together under isostatic pressure;

(f) pressurized gas inflation and superplastic shaping of the assembly and, (g) final machining of the shaped assembly.

FR-A-9511300 additionally proposes that, in view of the compaction of the primary parts in the regions of the diffusion barriers during the welding step, an operation to unstick the primary parts in these regions is carried out in the cold state before commencing the inflation and shaping step (f). This operation is in fact necessary to ensure the proper progress of the inflation and superplastic forming cycle in step (f) while guaranteeing an even supply of neutral gas through the cavities defined by the weldings and the diffusion barrier coatings. This operation of unsticking the parts of the blade between the welded areas permits control of the deformation rates from the very start of the forming cycle in step (f), and avoids the occurrence of excess pressures due to localized adherence of one blade part to another during the inflation cycle, which would lead to an undesirable excessive inflation and a risk of rupture.

The known methods of implementing the unsticking operation are not entirely satisfactory, however, and it is an aim of the invention to provide an improved method of carrying out this operation, and also to provide a device adapted for use in the method.

SUMMARY OF THE INVENTION

Accordingly, in the known process for the manufacture of a hollow turbomachine blade as described earlier, the invention proposes that the step of unsticking the primary parts of the blade in the regions which are not welded due to the presence of the diffusion barriers includes the steps of subjecting the welded assembly to localized heating in a region where intercavity communication holes are provided in the intermediate sheet of the assembly, and injecting pressurized gas into the assembly in a controlled manner to hot form a gas distribution duct in the locally heated region of the assembly to facilitate unsticking of the remainder of the non-welded regions.

Depending on the particular application, the unsticking operation, including the hot forming of the gas distribution duct, may be carried out on a diffusion welded assembly which is flat or which has been subjected to a preliminary shaping by twisting or bending. Alternatively it may be carried out during the course of a shaping operation which involves twisting of the welded assembly.

The invention also provides apparatus for use in carrying out the hot forming of the gas distribution duct and the rest of the unsticking operation, comprising jaws having surfaces shaped to define a mould for the portion of the welded assembly which is to form the gas distribution duct, heating elements in said jaws, and a movable table carrying a gas supply system, temperature and pressure regulating equipment, and an article support fitted with sensors able to detect micro-displacements.

Other preferred features and advantages of the invention will become apparent from the following description of a preferred embodiment of the invention with reference to the attached drawings.

DESCRIPTION OF THE PREFERRED EMBODIMENT

Figure 1:
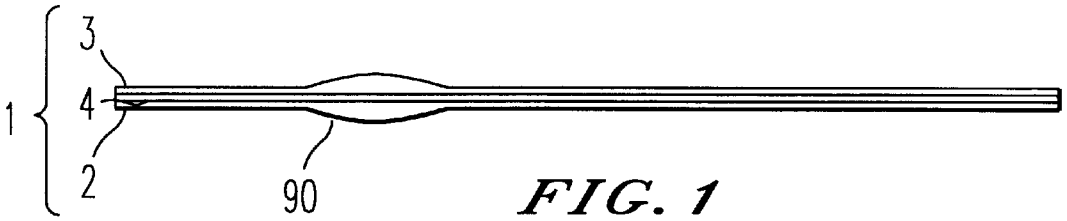
FIG. 1 is a diagrammatic sectional view of a welded blade assembly showing the gas distribution duct formed in the course of manufacture of a blade in accordance with the invention.
Figure 2:
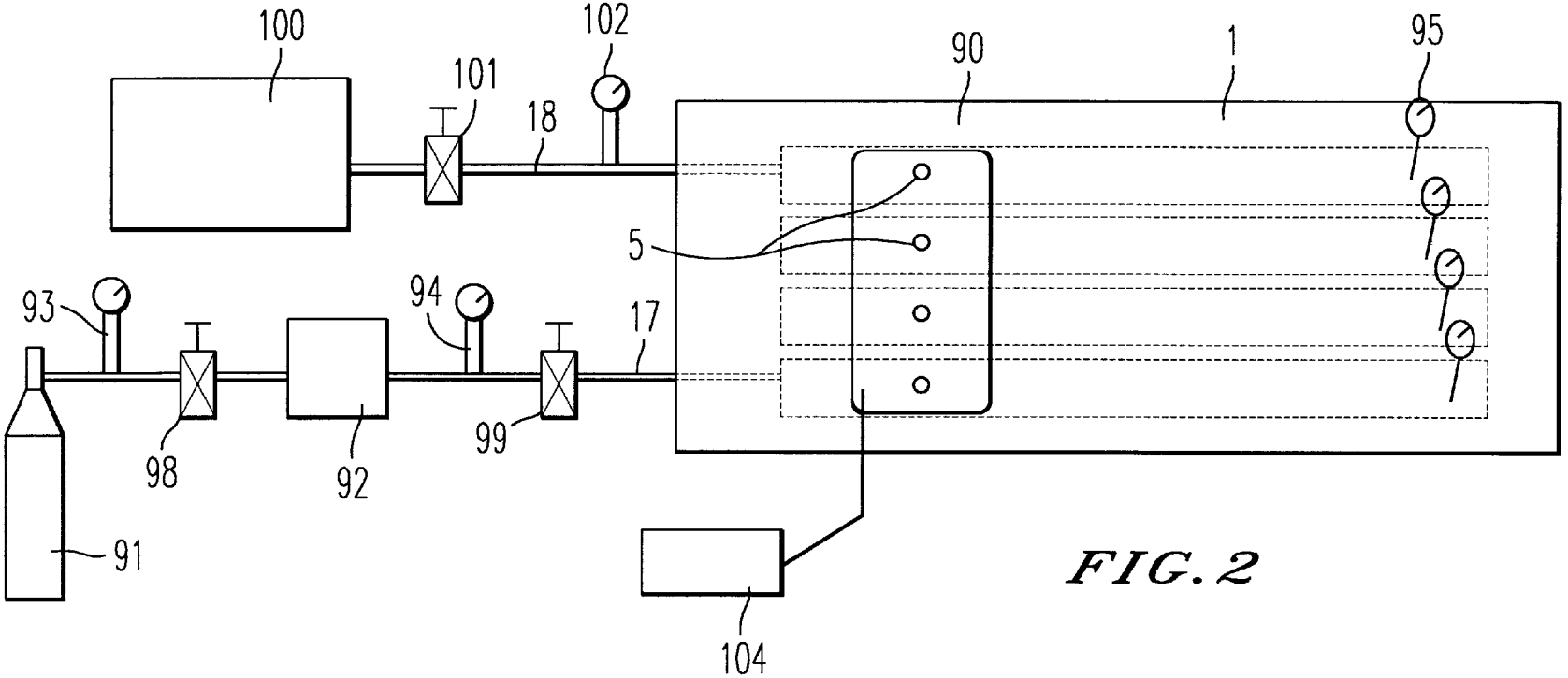
FIG. 2 is a diagrammatic view illustrating the implementation of an operation to unstick the areas of the blade parts provided with a coating forming a diffusion barrier in the manufacture of the blade; and, FIG. 3 is a diagrammatic view of the apparatus used for carrying out the operation.
Figure 3:
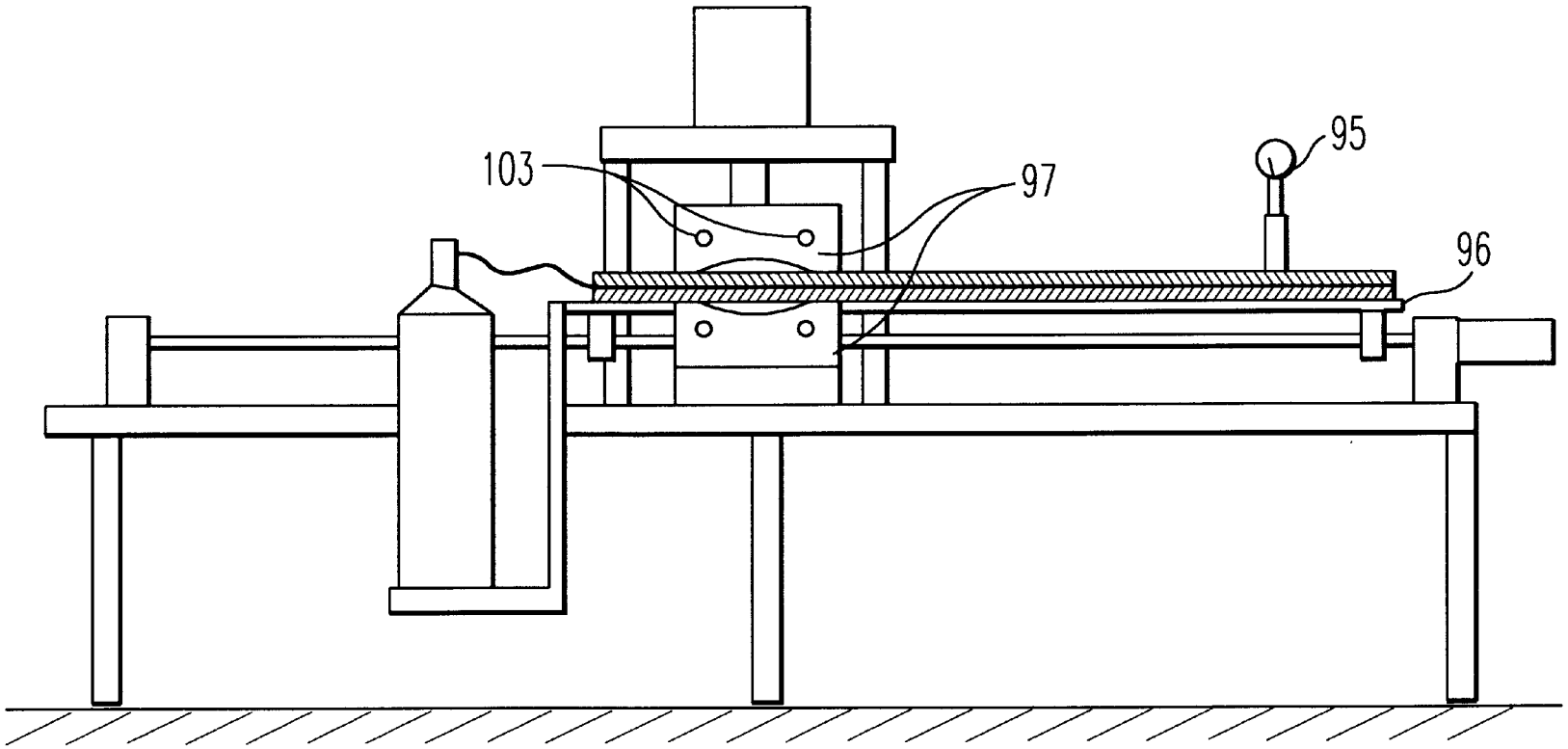

FIGS. 1 to 3 show diagrammatically an intermediate stage in the manufacture of a hollow turbomachine blade, particularly a large chord blade intended for the rotor of the fan in a bypass turbojet engine, in which the blade assembly 1 comprises a lower sheet 2 for forming the intrados face of the blade, an upper sheet 3 for forming the extrados face of the blade, and an intermediate sheet 4 intended to form the stiffeners of the blade. As is known, at least one of the facing surfaces of the constituent sheets of the blade assembly has been provided with a coating forming a diffusion barrier in a predefined pattern, and a metallurgical bond in the facing areas not provided with the antidiffusion coating is formed by diffusion welding under isostatic pressurization.

In order to facilitate the subsequent formation of the internal cavities of the blade by inflation of the assembly 1 using pressurized neutral gas and by superplastic shaping of the assembly, the manufacturing process in accordance with the invention then involves an operation to unstick the sheets 2 and 3 from the central sheet 4 in the regions where they are not diffusion welded to the sheet 4 due to the presence of the diffusion barrier coating.

For this purpose, the blade assembly 1 is placed on a support carried by a movable table 96, such as shown in FIG. 3. As shown in FIG. 2, gas flow tubes 17 and 18 are connected to the blade assembly 1, the tube 17 leading from a reservoir 92 supplied by a neutral gas dispensing source 91 with pressure sensors 93 and 94 and valves 98 and 99 being provided in the tube on opposite sides of the reservoir 92, and the tube 18 leading to an expansion chamber 100 via a valve 101 and a pressure sensor 102. On the movable table 96, a specific area 90 of the blade assembly 1, within which the central sheet 4 has holes 5 which establish communication between the cavities formed between the welded areas of the assembly 1, is arranged between clamping jaws 97 provided with heating elements 103. Temperature sensors 104 are placed in communication with the said area 90 of the assembly 1.

The unsticking involves heating the area 90 of the blade assembly to a temperature within the range where the material constituting the blade becomes plastic. As soon as this temperature is reached, controlled injections of highly pressurized gas are supplied to the assembly through the tube 17. Under the pressure of the injected gas the sheets 2 and 3 become deformed progressively from one cavity to the next to form a duct 90 between the tubes 17 and 18, this duct 90 subsequently permitting balanced gas distribution into each of the cavities.

Initially, the reservoir 92, which has a specific capacity, is filled from the neutral gas dispensing source 91 until the working pressure is obtained. The pressure sensors 93–94 provide data regarding the operational conditions. As soon as the reference pressure is reached upstream of the reservoir, the supply from the source is cut off and pressurized gas is released through the tube 17 towards the assembly 1. The gas then infiltrates into the blade assembly 1 until it reaches the heated zone 90 where the sheets 2, 3 start to separate under the pressure and deform plastically to form a portion of the duct corresponding to the volume of gas introduced from the reservoir 92. This operation is repeated as many times as is necessary to achieve the required final shape to the duct 90. As soon as the formation of the duct 90 is completed, heating is cut off and further pulses of gas are injected into the assembly 1 to effect the unsticking of the whole of the cavities. The gas injected infiltrates progressively between the sheets and thus brings about the unsticking of all the areas provided with the anti-diffusion coating. At the opposite end of the assembly from the distribution duct 90, sensors 95 provided in line with the cavities measure the micro-deformations caused by the gas infiltration and supply information indicating the completion of the unsticking operation.

In the application of the method to the manufacture of a large chord fan blade made of a type TA6V titanium alloy, the range of temperatures entertained for the heating of the zone 90 of the assembly 1 extends from 880° C. to 940° C. and this temperature is reached in a few seconds. The inner surfaces of the jaws 97 preferably correspond to the shape of the duct 90 hot formed in the assembly 1 by plastic deformation of the sheets 2 and 3, and effectively define a mould for the formation of the duct 90. The pressure of gas injected along the supply tube 17 is preferably between 1 MPa and 6 MPa. Injection is continued until the pressure equalizes between the tubes 18 and 17. At this stage, the heating is cut off, and the unsticking of the rest of the assembly can start. Injections of gas from the reservoir 92, regulated in terms of both pressure and rate of flow, start the unsticking of the sheets, and when the pressure drop at 94 reaches a preset threshold a new gas injection is made. This cycle is repeated until all the detectors 95 have detected micro-deformation.

We claim:

1. A process for manufacturing a hollow turbomachine blade, comprising the steps of:

(a) using computer aided design and manufacturing (CAD/CAM) means to create, from a definition of a blade to be produced, a digital simulation of a flat form of primary parts of said blade;

(b) die-forging said primary parts in a press;

(c) machining said primary parts;

(d) depositing diffusion barriers on said primary parts according to a predefined pattern which determines a final internal geometry of the blade;

(e) assembling said primary parts with an intermediate sheet having intercavity communication holes and diffusion welding them together under isostatic pressure, thereby forming a welded assembly of said primary parts;

(f) unsticking said primary parts in regions which are not welded as a result of a presence of said diffusion barriers;

(g) performing pressurized gas inflation and superplastic shaping of the welded assembly of said primary parts; and (h) final machining of the shaped assembly;

wherein said unsticking step (f) includes:

(f1) subjecting the welded assembly to localized heating in a region where said intercavity communication holes in said intermediate sheet are located; and (f2) injecting pressurized gas into the welded assembly in a controlled manner to hot form a gas distribution duct in the region subjected to localized heating of the welded assembly to facilitate unsticking of a remainder of the non-welded regions.

2. A process according to claim 1, wherein said unsticking step (f), including said step of hot forming said gas distribution duct, is carried out on a welded assembly which is flat.

3. A process according to claim 1, wherein the welded assembly obtained from step (e) is subjected to a preliminary shaping by twisting or bending before said unsticking step (f) is carried out.

4. A process according to claim 1, wherein said unsticking step (f), including said step of hot forming said gas distribution duct, is carried out in the course of a step of shaping said welded assembly by twisting.

* * * * *